US010112235B2

(12) United States Patent
Egeler et al.

(10) Patent No.: US 10,112,235 B2
(45) Date of Patent: Oct. 30, 2018

(54) ARRANGEMENT FOR USE IN THE PRODUCTION OF A SEPARABLE CASTING MOULD

(71) Applicants: Huettenes-Albertus Chemische Werke GmbH, Duesseldorf (DE); Chemex GmbH, Delligsen (DE)

(72) Inventors: Nicolas Egeler, Krefeld (DE); Michael Biemel, Wuerzburg (DE); Heiko Schirmer, Delligsen (DE)

(73) Assignees: CHEMEX GMBH, Delligsen (DE); HUETTENES-ALBERTUS CHEMISCHE WERKE GMBH, Duesseldorf (DE)

( * ) Notice: Subject to any disclaimer, the term of this patent is extended or adjusted under 35 U.S.C. 154(b) by 350 days.

(21) Appl. No.: 14/820,642

(22) Filed: Aug. 7, 2015

(65) Prior Publication Data

US 2016/0038996 A1 Feb. 11, 2016

(30) Foreign Application Priority Data

Aug. 7, 2014 (DE) ..... 10 2014 215 715

(51) Int. Cl.

| | |
|---|---|
| ***B22C 11/00*** | (2006.01) |
| ***B22C 7/04*** | (2006.01) |
| ***B22C 9/08*** | (2006.01) |
| ***B22C 21/14*** | (2006.01) |
| ***B22C 19/00*** | (2006.01) |

(52) U.S. Cl.

CPC ..... *B22C 11/00* (2013.01); *B22C 7/04* (2013.01); *B22C 9/088* (2013.01); *B22C 19/00* (2013.01); *B22C 21/14* (2013.01)

(58) Field of Classification Search

CPC ..... B22C 11/00; B22C 19/00; B22C 21/14; B22C 9/088; B22C 7/04

See application file for complete search history.

(56) References Cited

U.S. PATENT DOCUMENTS

| | | | |
|---|---|---|---|
| 2005/0236132 | A1 | 10/2005 | Powell |
| 2012/0211192 | A1 | 8/2012 | Sallstrom |

(Continued)

FOREIGN PATENT DOCUMENTS

| | | |
|---|---|---|
| DE | 20112425 | 10/2001 |
| WO | 2014191423 | 12/2014 |

*Primary Examiner* — Kevin P Kerns
*Assistant Examiner* — Steven S Ha
(74) *Attorney, Agent, or Firm* — Duane Morris LLP; J. Rodman Steele, Jr.; Gregory M. Lefkowitz

(57) ABSTRACT

An arrangement for use in the production of a separable casting mold, preferably of a vertically separable casting mold is disclosed. The arrangement can include (i) a mold plate and/or a mold pattern, (ii) a feeder system having a feeder element and having a feeder insert, wherein feeder element and feeder insert delimit a feeder cavity for receiving liquid metal. The arrangement also includes one or more tipping prevention elements which are designed to counteract tipping of the feeder system out of the opening axis about the first end of the feeder element when, in the event of the feeder system being acted on with a force acting parallel to the opening axis and in the direction of the first end, the side wall deforms and the spacing between the first and second ends is reduced, wherein the one or more tipping prevention element(s) are/is spaced apart from the opening axis.

11 Claims, 8 Drawing Sheets

(56) References Cited

U.S. PATENT DOCUMENTS

Figure 1A:
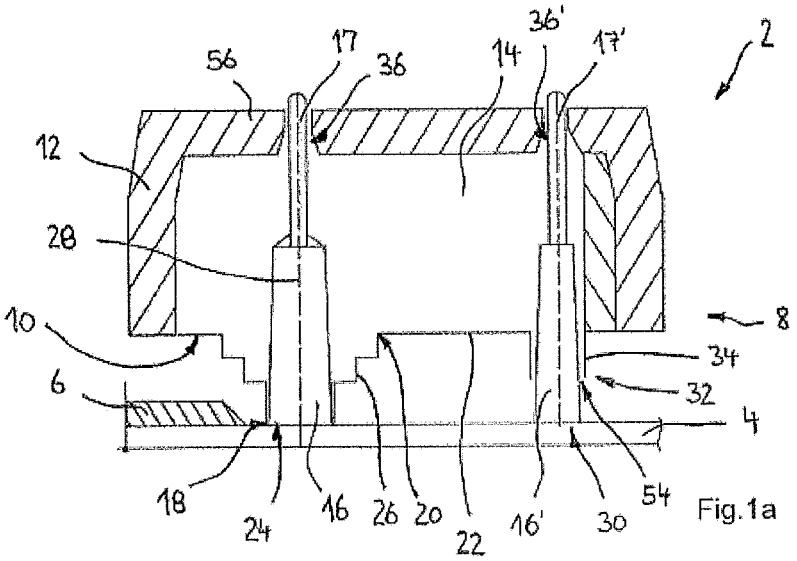

| | | | | |
|---|---|---|---|---|
| 2013/0306685 | A1 | 11/2013 | Sallstrom | |
| 2016/0101461 | A1* | 4/2016 | Beckmann | B22C 9/088 164/137 |

* cited by examiner

ARRANGEMENT FOR USE IN THE PRODUCTION OF A SEPARABLE CASTING MOULD

The present invention relates to an arrangement for use in the production of a separable casting mould, preferably of a vertically separable casting mould, comprising a mould plate and/or a mould pattern, a feeder system having a feeder element and having a feeder insert, wherein feeder element and feeder insert delimit a feeder cavity for receiving liquid metal, wherein the feeder element has a first end by which the feeder element is seated on, or arranged with a spacing to, the mould plate and/or the mould pattern, has a second end which is situated opposite the first end and which has an assembly element on which the feeder insert is arranged, has at least one passage opening, which extends from the first end to the second end, for the liquid metal, wherein the passage opening is delimited by a side wall, wherein the side wall can be deformed so as to reduce the spacing between the first and second ends, and wherein the passage opening has an opening axis, wherein the feeder cavity has a centre of volume which is offset relative to the opening axis.

Feeder systems, also referred to as feeders, are used in the production process of the casting of metals in casting moulds. Feeder systems normally form a cavity, wherein the feeder system is surrounded by a mould material, for example mould sand, used for producing the casting mould. The casting chamber provided within the casting mould for receiving the liquid metal has a passage to the feeder cavity, into which a partial amount of the liquid metal poured into the casting mould then enters during the casting process. It is the intention for the liquid metal that has thus passed into the feeder to be able to flow back into the casting mould during the solidification process (which is associated with a contraction of the cast metal) in order, there, to compensate for the shrinkage of the casting until the solidus temperature is reached.

To ensure that the metal situated in the feeder flows back out, it must be ensured that the metal in the feeder insert remains in the liquid state while the metal in the interior of the casting mould is already solidifying or has already partially solidified to form the casting. For this purpose, at least a part of the feeder insert is normally composed of an insulating and/or exothermic material, wherein, as liquid metal enters the feeder insert, an exothermic material is ignited owing to the prevailing temperatures. From this moment onward, an exothermic reaction then takes place within the material of the feeder insert automatically. During the exothermic reaction, heat energy is supplied to the metal situated in the feeder cavity over a certain period of time, and the metal in the feeder system and in the transition region to the casting cavity of the casting moulds is kept in the liquid state.

Owing to considerably increased demands for productivity also in the casting sector, possibilities have been sought for automating mould production and thus enabling casting moulds for castings to be produced in large unit quantities. For this purpose, automated, vertical green sand moulding installations (for example Disamatic moulding machines from DISA Industries A/S) have for example been developed in which, for example, a first pattern half is installed on an exclusively linearly adjustable press piston. An associated second pattern half is normally installed on a pivotable mould plate which is moved back and forth between a horizontal orientation, in which said mould plate is for example equipped with a feeder, and a vertical orientation. In its vertical working position, the pivotable mould plate is commonly likewise displaceable, preferably parallel to the first pattern half. In the case of vertically separable casting moulds, by means of which relatively thin-walled castings can be produced, there is for example the problem of ensuring refeeding of for example insulated, heavy casting sections. To ensure the refeeding of such insulated regions, feeder systems are used whose feeder longitudinal axes are oriented approximately perpendicular to the pivotable mould plate, such that the feeder longitudinal axis of a feeder system arranged in this way runs approximately horizontally during the casting process. A feeder system or, respectively, a feeder of said type has a shaped element which can be placed in contact with a mould pattern or a pivotable mould plate and which is equipped with a passage opening for the liquid metal.

The publications EP 2 489 450 B1 (DE 20 2011 103 718 U1) and EP 2 664 396 B1 (DE 20 2012 102 418 U1) have each disclosed an arrangement for use in the production of a separable casting mould. The known arrangements comprise a mould plate and/or a mould pattern, and furthermore at least one feeder system with a feeder element and a feeder insert. The feeder element and the feeder insert in this case delimit a feeder cavity for receiving the liquid metal. The feeder element has a first end by which the feeder element is normally directly in contact with, or seated on, the mould plate and/or the mould pattern. The feeder element furthermore has a second end which is situated opposite the first end and on which the feeder insert is arranged. On the second end of the feeder element there is provided an assembly element at which the feeder insert is fastened to the feeder element. The feeder element has at least one passage opening, which extends from the first end to the second end, for the liquid metal, which passage opening, during use, corresponds with the passage to be produced on the casting mould, such that a corresponding part of the liquid metal can, during the filling process, enter the feeder cavity from the casting chamber and, during the solidification process, flow back from the feeder cavity into the casting chamber again. The passage opening is delimited by a side wall which is deformable.

The side wall is designed to be deformable in particular in order that it can better absorb the forces that act on the feeder system during the compaction of the mould material that is used for producing the casting mould. The side wall of the passage opening deforms such that the spacing between the first and the second end of the feeder element is reduced. The passage opening has an opening axis which is commonly oriented perpendicular to a surface region, on which the feeder element is seated by way of its first end, of the mould plate and/or of the mould pattern. The feeder cavity, formed by feeder element and feeder insert, of the known feeder has in this case a centre of volume which is offset relative to the opening axis of the passage opening. Owing to the opening axis being arranged offset with respect to the centre of volume, it is the case during the casting process that, if a predominant part of the volume of the feeder cavity is positioned above the opening axis during the use of the feeder, the liquid metal enters a lower region of the feeder and thus rises vertically with respect to the opening axis in the interior of the feeder cavity. In this way, it is intended to achieve improved refeeding of the metal during the solidification process and the associated shrinkage of the casting.

In the case of the known arrangements for use in the production of a separable casting mould, use is optionally also made of centring pins which normally extend along the opening axis of the passage opening. The centring pins that are used serve at least for positioning the feeders or feeder systems which are to be mounted on the mould plate and/or on the mould pattern. In the case of feeder systems whose centre of volume is offset with respect to the opening axis of the passage opening for the liquid metal, it is the case during the compaction of the mould material that a force or a force field acts on the feeder system such that, in the region of the abutment and/or mounting point of the first end of the feeder element on the mould plate and/or mould pattern, a tipping moment is generated about a pivot axis, which normally runs perpendicular to the opening axis. The tipping moment that acts leads, under some circumstances, to tipping or a pivoting movement of the feeder system relative to the mould plate and/or relative to the mould pattern, resulting in non-uniform abutment of the mounting region of the first end of the feeder element on the mould plate or on the mould pattern after the process of compaction of the mould material. By means of a centring pin, the abovementioned problem can be partially alleviated, as the feeder element and feeder insert are normally placed in abutment with predetermined sections of the centring pin, and are held by the centring pin in a direction perpendicular to the direction of extent thereof. Above a particular pressure force during the compaction or compression of the mould material, it is however the case, as stated in the citations EP 2 489 450 B1 (DE 20 2011 103 718 U1) and EP 2 664 396 B1 (DE 20 2012 102 418 U1), that the holding force generated by the centring pin is not sufficient to prevent tipping of the feeder system, or preventing tipping in such a way that disadvantages during the casting process are ruled out.

Taking the above-stated problem as a starting point, it is the object of the invention to specify an arrangement for use in the production of a separable casting mould, with which arrangement, during the production of the casting mould in a separable casting mould, tipping of the feeder system on the mould pattern and/or the mould plate is at least reduced, or at best completely eliminated, even in the presence of high compaction pressures.

The invention achieves the object on which it is based, in the case of an arrangement of the type mentioned in the introduction, in that the arrangement additionally comprises one or more tipping prevention elements which are designed to counteract tipping of the feeder system out of the opening axis about the first end of the feeder element when, in the event of the feeder system being acted on with a force acting parallel to the opening axis and in the direction of the first end, the side wall deforms and the spacing between the first and second ends is reduced, wherein the one or more tipping prevention element(s) are/is spaced apart from the opening axis.

The invention thus relates to an arrangement which is suitable for use in the production of a separable casting mould, preferably of a vertically separable casting mould, which are produced using vertical moulding installations such as, for example, Disamatic moulding machines from DISA Industries A/S. The arrangement comprises (i) a mould plate and/or a mould pattern and (ii) a feeder system having a feeder element and having a feeder insert. The feeder element and the feeder insert of the feeder system are designed to delimit a feeder cavity for receiving liquid metal. The feeder element has a first end by which the feeder element is seated on, or arranged with a spacing to, the mould plate and/or the mould pattern. The first end is thus situated in abutment with the mould plate and/or mould pattern or is, in another embodiment, held with a small spacing to the mould plate and/or mould pattern by way of a spacer. In the present case, a small spacing is to be understood to mean a spacing dimension of a few tenths of a millimeter to a few millimeters. Furthermore, the feeder element has a second end which is situated opposite the first end and which has an assembly element on which the feeder insert is arranged. Furthermore, the feeder element has at least one passage opening, which extends from the first end to the second end, for the liquid metal, wherein the passage opening is delimited by a side wall. The feeder element is preferably positioned on a mould plate or on a mould pattern such that the passage opening corresponds with a passage of the casting mould to be produced. The side wall that delimits the passage opening can preferably be deformed to reduce the spacing between the first and the second end of the feeder element, such that, during the production of the casting mould, the feeder system can yield to a predetermined extent to a pressure force acting on the feeder system during the compaction of the mould material. In this way, damage to or even fracture of the feeder insert owing to an excessive mould pressure can be prevented. The passage opening has an opening axis which extends preferably perpendicular to the mould plate and/or to the mould pattern, wherein the feeder cavity formed by the feeder element and the feeder insert has a centre of volume which is offset relative to the opening axis. Thus, during use of the feeder system in a vertical moulding installation (that is to say when the opening axis has assumed a horizontal orientation), the opening axis of the feeder element is arranged offset in a downward direction relative to the centre of volume of the feeder cavity that is formed. The metal-conducting passage between the casting mould and feeder cavity is thus then connected to a lower region of the feeder system. The predominant part of the volume of the feeder cavity is thus situated above the opening axis of the passage opening. The opening axis preferably extends through the centres of area of the free cross sections of the passage opening formed in each case at the first end and at the second end of the feeder element. The free cross sections of the passage opening at the first and at the second end are preferably arranged concentrically. The arrangement according to the invention additionally comprises one or more tipping prevention elements which are designed to counteract tipping of the feeder system out of the opening axis about the first end of the feeder element. The tipping is in particular counteracted at the time of the compaction of the mould material, when the feeder system is acted on with a force acting at least parallel to the opening axis and in the direction of the first end of the feeder element, whereby at the same time, the side wall is deformed and the spacing between the first and the second end of the feeder element is reduced. To be able to effectively counteract the force or force field acting on the feeder system in particular outside the opening axis of the feeder system, the one or more tipping prevention elements is or are arranged spaced apart from the opening axis.

The invention is based on the realization that, with one or more tipping prevention elements, it is advantageously possible, during the compaction of the mould material that forms the casting mould and an associated reduction in spacing between the first and the second end, for tipping of the feeder system on the mould plate and/or on the mould element to be counteracted. Thus, the first end of the feeder element is preferably seated in uniform fashion by way of its mounting region on the side wall, which delimits the passage opening, on the mould plate and/or or the mould pattern. By means of the at least one tipping prevention element which is arranged spaced apart from the opening axis of the passage opening, a counteracting force which opposes the pressure force generated during the compaction of the mould material and which acts on the feeder element from below is at least temporarily generated at the second region of the feeder element (with the corresponding distance to the side wall of the feeder element). Alternatively, for a counteracting force at two points of the feeder element, guidance of the feeder element of the feeder system is implemented by means of a tipping prevention element according to the invention at at least one region which is at a sufficient distance from the passage.

In a preferred embodiment of the arrangement according to the invention, the tipping prevention element is arranged on the feeder element, and/or on the mould plate or the mould pattern, at a distance from the deformable side wall of the feeder element, which distance is preferably greater than the distance between the opening axis and the centre of volume, which is offset with respect thereto, of the feeder cavity. By means of the tipping prevention element which is arranged at a distance, or correspondingly remotely, from the deformable side wall, the pressure force acting on the feeder system can be counteracted in simplified fashion. The distance from the tipping prevention element to the deformable side wall of the feeder element is preferably such that two support points are formed on the feeder element, which support points preferably uniformly counteract the force or force field acting on the feeder element. The distance to the deformable side wall is preferably greater than the distance between the opening axis and the centre of volume, which is offset with respect thereto, of the feeder cavity, whereby it is ensured that the tipping prevention element itself does not serve as a tipping point about which the feeder system would then tip or pivot. In this way, undesired lifting of the first end of the feeder element from the mould pattern and/or from the mould plate is prevented, and secure seating of the first end on the mould plate and/or mould pattern during the process of compaction of the mould material (in which the casting mould is generated) is ensured. A tipping prevention element arranged on the feeder element and/or on the mould plate or on the mould pattern is to be understood to mean a tipping prevention element which is either fixedly arranged on the feeder element or is an integral constituent part of said feeder element, or which is fastened to the mould plate and/or to the mould pattern or is in each case an integral constituent part of the mould plate and/or mould pattern. Alternatively, a tipping prevention element of said type is also to be understood to mean a tipping prevention element which is merely arranged between the feeder element and mould plate and/or mould pattern and which is in contact with the respective corresponding components without imperatively having to be connected thereto.

The tipping prevention element is preferably a support part which is arranged between (i) the mould plate and/or the mould pattern and (ii) the assembly element of the feeder element and/or the feeder insert, which support part is variable, preferably compressible, in terms of its height dimension. It is preferably the case that, by means of the support part, during the entire process of compaction of the mould material and the associated reduction in spacing between the first and the second end of the feeder element, a counteracting force is exerted on the feeder element preferably with a spacing to the deformable side wall. By way of the counteracting forces that now act on two surface regions of the feeder element (first end of the feeder element and support part), it is preferably the case that, during the reduction in spacing between the first and second ends of the feeder element, the spacing dimension of the feeder element to the mould plate and/or to the mould pattern varies substantially uniformly. In a preferred embodiment, the tipping prevention element that is used exhibits virtually identical deformation behaviour to the deformable side wall of the passage opening.

In one refinement of the arrangement according to the invention, the support part is an elastic spring element or a spring pin, which are designed to generate a counteracting force spaced apart from the side wall of the passage opening as said side wall is deformed. The support part is preferably supported by way of one end on the mould plate and/or on the mould pattern, and by way of the other end on the underside of the feeder element or on the inner side of the feeder insert which is connected to the feeder element.

Alternatively or optionally, in one refinement of the arrangement according to the invention, the tipping prevention element is a spacer which projects in the direction of the feeder element from a surface, facing toward the feeder element, of the mould pattern and/or of the mould plate, and/or protrudes from the feeder element in the direction of the mould plate or of the mould pattern, and which is designed to maintain a minimum spacing between (ii) feeder element and (i) mould plate or mould pattern after the deformation of the side wall. The use of such a spacer according to the invention represents a simple design option for counteracting tipping of the feeder system out of the opening axis about the first end of the feeder element. The spacer according to the invention is designed such that the spacing dimensions of surface regions of the feeder element to the mould plate and/or the mould pattern have a uniform differential dimension with regard to the spacings before and after the deformation of the deformable side wall. During the process of compaction of the mould material and thus during the change in spacing between the first and second ends of the feeder element, tipping is duly possible under some circumstances. However, the tipping is, at least at the end of the compaction process and thus temporarily, counteracted such that the feeder system that has pivoted out of the opening axis is pivoted back or tipped back. The height of the spacer which protrudes from the feeder element, in particular from the assembly element thereof, and/or from the assembly plate and/or from the mould pattern is in particular configured such that the height dimension thereof corresponds to the spacing that remains between the first and second ends of the feeder element at the end of the compaction process.

The spacer is preferably a material projection which projects from the assembly element in the direction of the mould pattern and/or the mould plate and which preferably has a wall, protruding substantially perpendicularly from the assembly element, and a support surface, which runs approximately parallel to the assembly element. An embodiment in the form of a material projection on the feeder element is a structurally simple means for forming a spacer according to the invention. Alternatively, the spacer is a structural part of the mould pattern and/or of the mould plate which protrudes from the mould pattern and/or from the mould plate in the direction of the feeder element. The structural part, which is arranged spaced apart from the mounting region of the first end of the feeder element, is preferably an integral constituent part of the mould plate and/or mould pattern. The formation of a spacer on the mould pattern and/or on the mould plate can be implemented in a simplified manner in terms of design, whereby a tipping prevention element which counteracts the tipping of the feeder system in an effective manner is realized. Also, a spacer generates a counteracting force, which acts preferably perpendicularly on the feeder element, with a spacing to the deformable side wall of the passage opening. Here, it is likewise crucial that the height of the spacer provided on the mould plate and/or on the mould pattern corresponds relatively accurately to the final spacing or the final height between the first and second ends of the feeder element after the deformation.

Another alternative or optional design of the arrangement according to the invention provides that the tipping prevention element is a guide part which is arranged on the mould pattern and/or the mould plate and which corresponds with an additional receptacle on the feeder element, preferably on the assembly element, and along which the receptacle slides during the deformation of the side wall. Instead of a counteracting force being exerted by a support part or a spacer directly on the feeder element, guidance of the feeder element is realized at a distance from the deformable side wall of the feeder element by means of the guide part according to the invention. It is preferably the case that a receptacle, in the form of an aperture, of the assembly element of the feeder element is guided such that, during the process of compaction of the mould material during the production of the casting mould, the feeder system cannot tip about the first end, which is preferably seated directly on the mould pattern and/or on the mould plate. By means of the guide part, similarly to the situation with the support part, it is ensured that mutually spaced-part regions of the feeder element experience a uniform change in spacing to the mould plate and/or to the mould pattern during the deformation of the side wall.

The guide part preferably has one or more guide surfaces which are preferably oriented parallel to the opening axis of the passage opening. A preferably directed movement of the feeder element and thus of the feeder system of a whole perpendicular to the mould plate or to the mould pattern is thus effected. The guide part, which is preferably arranged on the mould plate and/or on the mould pattern so as to protrude perpendicularly therefrom, is in this case permanently in abutment with one or more guide surfaces of the receptacle on, preferably, the assembly element of the feeder element, which receptacle is preferably in all-round abutment with the guide part.

Another refinement of the invention provides that the guide part is a centring pin arranged on the mould pattern and/or on the mould plate, or is a structural part, which projects into the feeder cavity, of the mould pattern and/or of the mould plate. By means of the centring pin or the structural part, which projects at least in sections into the feeder cavity, simplified positioning of the feeder system on the mould plate and/or on the mould pattern is possible. The passage opening and the receptacle, which corresponds with the guide part, on the feeder element may be fixedly oriented or positioned with respect to predetermined regions of the mould plate and/or mould pattern by way of a protruding centring pin or a structural part. An alternative refinement of the arrangement according to the invention provides that, for the positioning of the feeder system, a centring pin as tipping prevention element is provided spaced apart from the side wall of the passage opening, whereas the passage opening, in particular the mounting region, of the side wall that delimits the passage opening is positioned on a structural part which projects in the manner of a pin from the mould pattern and/or from the mould plate, which structural part has a height corresponding to a fraction of the spacing between the first and second ends of the feeder element.

In one refinement of the arrangement according to the invention, as an alternative or in addition to the tipping prevention elements, it is preferably provided that the feeder element (as a component of a feeder system according to the invention), preferably the assembly element thereof, additionally has one or more ventilation openings for the ventilation of the feeder cavity which is delimited by the feeder element and feeder insert. In the case of a horizontal arrangement of the opening axis of the passage opening, the ventilation opening should preferably be arranged or positioned above the passage opening on the feeder element. By way of the ventilation opening, it is advantageously ensured during the use of the feeder system that no air cushion forms in the feeder cavity, in particular in the volume fraction that can be positioned above the passage opening for the liquid metal; such an air cushion could hinder the liquid metal from rising within the feeder cavity during the filling process. Thus, at all times, there is stored in the feeder cavity a sufficient amount of liquid metal which can flow back into the casting mould during the shrinkage of the casting as it solidifies. The ventilation opening is preferably arranged or formed on the feeder element which changes its spacing with respect to the mould pattern and/or the mould plate during the compaction of the mould material. In this case, the discussed formation of the ventilation opening on the feeder element of the feeder system is an independent aspect of the invention which should also be considered independently of the arrangement or the provision of one or more tipping prevention elements which counteract tipping of the feeder system out of the opening axis about the first end of the feeder element. Therefore, a further independent aspect of the present invention relates to an arrangement for use in the production of a separable casting mould, preferably of a vertically separable casting mould, comprising (i) a mould plate and/or a mould pattern, (ii) a feeder system having a feeder element and having a feeder insert, wherein feeder element and feeder insert delimit a feeder cavity for receiving liquid metal, wherein the feeder element has a first end by which the feeder element is seated on the mould plate and/or the mould pattern, has a second end which is situated opposite the first end and which has an assembly element on which the feeder insert is arranged, has at least one passage opening, which extends from the first end to the second end, for the liquid metal, wherein the passage opening is delimited by a side wall, wherein the side wall can be deformed so as to reduce the spacing between the first and second ends, and wherein the passage opening has an opening axis, wherein the feeder cavity has a centre of volume which is offset relative to the opening axis, wherein the feeder element, preferably the assembly element thereof, additionally has one or more ventilation openings for the ventilation of the feeder cavity which is delimited by the feeder element and feeder insert. This independent aspect of the invention is combinable with the other aspects of the present invention; with regard to preferred combinations, that which is stated in the corresponding text passages applies correspondingly.

In another refinement of the arrangement according to the invention, the ventilation opening is arranged offset with respect to the opening axis of the feeder element in such a way that, preferably in the case of the horizontal orientation of the opening axis, the ventilation opening is arranged above the passage opening. In the case of a horizontal orientation of the opening axis of the passage opening, the ventilation opening is preferably positioned above the passage opening, and at the same time, the feeder cavity is preferably designed such that, in the case of a horizontal orientation of the opening axis, a predominant part of the volume of the feeder cavity is positioned above the passage opening. Alternatively or in addition, a ventilation opening is arranged or formed on the feeder insert.

The ventilation opening preferably comprises a wall for forming a ventilation duct which extends along a ventilation axis, wherein the ventilation axis runs, in sections or over its entire length, parallel to the opening axis of the passage opening. By means of a ventilation duct which runs horizontally at least in sections in the case of the feeder insert being used in a vertical moulding installation, a simple additional coupling to a structural or extension part (for example in the form of a support part which is variable in terms of its height dimension or a guide part which is arranged on the mould pattern and/or on the mould plate) arranged on the mould plate and/or on the mould pattern is possible, said coupling corresponding with an aperture (ventilation opening) in the feeder element. The ventilation duct preferably has a seal which is in sealing abutment with the guide or support part and by means of which the infiltration of mould material, such as mould sand, into the feeder cavity during the compaction process is prevented. A structural or extension part which corresponds with the ventilation duct on the feeder element is arranged on the pivotable mould plate and forms a shaped part which extends along a section of the mould plate. The structural or extension part is preferably an integral constituent part of the mould plate and/or mould pattern, and is arranged on the mould plate and/or mould pattern such that, during casting operation, a preferably vertically running ventilation duct is realized. By means of the structural or extension part, a shaped part for the ventilation duct which preferably runs vertically within the casting mould to be produced is formed, and at the same time, a mechanical coupling to the mould plate is realized by means of which additional securing of the feeder system according to the invention in position with respect to the mould pattern and/or with respect to the mould plate is effected. Furthermore, the configuration of the ventilation opening as a duct permits a rapid escape of the air situated in the feeder insert during the casting process.

The wall of the ventilation duct is preferably in the form of a spacer and/or in the form of a guided part which slides along the guide part arranged on the mould pattern and/or mould plate. In this way, it is advantageously achieved that predetermined regions of the feeder element both counteract tipping of the feeder element about its first end and furthermore realize a ventilation function from the feeder cavity. For this purpose, the feeder element has a preferably cylindrical wall which projects in the direction of the mould plate and/or of the mould pattern. The cylindrical wall is then seated in sealing fashion on the associated section of the mould pattern and/or of the mould plate after the compaction of the mould material and the associated deformation of the side wall. The height dimension of that wall of the ventilation duct which protrudes from the feeder element preferably corresponds to the spacing between the first and second ends of the feeder element after the compaction of the mould material. By virtue of a wall of the ventilation duct being formed, by contrast, merely as a guided part, reliable guidance along a guide part arranged on the mould plate and/or the mould pattern will primarily be ensured during the change in spacing between the first and second ends of the feeder element. The wall, which is in the form of a guided part, may be formed on the feeder element both in an outward direction and in an inward direction, that is to say so as to project in the direction of the feeder cavity.

In alternative refinement of the present invention, the wall of the ventilation duct is designed as a support part which is variable in terms of its height dimension, and is preferably deformable. The wall of the ventilation duct is preferably designed to be deformable similarly to the side wall which delimits the passage opening for the liquid metal. In this way, the side wall of the passage opening and the wall of the ventilation duct exhibit preferably identical deformation behaviour in conjunction with the force which acts on the feeder system in parallel in the direction of the opening axis during the process of compaction of the mould material. By way of identical deformation behaviour, a uniform change in spacing of the feeder element as a whole with respect to the mould plate and/or the mould pattern arranged relative thereto is ensured. By means of a deformable wall of the ventilation duct, it is thus simultaneously possible for a ventilation function to be implemented, and furthermore, a tipping prevention element can be formed by means of which tipping of the feeder system is counteracted or, in the best case, prevented.

With regard to the abovementioned configuration of the wall of the ventilation duct as a spacer, guided part or support part, the wall of the ventilation duct protrudes substantially perpendicularly from the feeder element or is of stepped form. By means of the ventilation duct wall running perpendicular or parallel to the opening axis of the passage opening, a structurally simple design of a spacer which is supported on the mould pattern and/or on the mould plate at the end of the compaction process, and which maintains the minimum spacing between feeder element and mould plate and/or mould pattern, is ensured. The preferably cylindrical ventilation duct wall has a preferably high strength, at which undesired deformation and thus tipping of the feeder system is prevented. Of a similar design is ventilation duct wall in the form of a guided part, by means of which support forces acting preferably perpendicularly on the guide surfaces of the wall of the ventilation duct and of the guide part arranged on the mould pattern and/or mould plate can be received or absorbed. By contrast, the ventilation duct wall with which the function of the support part is implemented preferably has a stepped form, whereby multiple wall regions running in each case at predefined angles with respect to one another are formed, which specifically permit a deformation of the ventilation duct. The stepped ventilation duct is preferably compressible in the direction of extent.

Another refinement of the arrangement according to the invention provides that the ventilation opening is formed preferably on the support surface of the spacer which protrudes from the feeder element, or is formed separately from the spacer on the feeder element. In the case of a ventilation opening on the support surface of the spacer arranged on the feeder element, the ventilation opening is delimited by the support surface which is supported on the mould plate and/or mould pattern. In this way, the ventilation opening and a ventilation duct which is formed for example by the spacer project in the direction of the mould pattern and/or of the mould plate. After the compaction of the mould material, the ventilation opening which opens out at the support surface of the spacer is preferably seated directly on the mould plate or on an extension or structural part, arranged on the mould plate, for forming a ventilation duct. Alternatively, the ventilation opening is arranged separately from, or adjacent to, the spacer on the feeder element. Such a ventilation opening is preferably arranged in the assembly element of the feeder element at a distance from the passage opening of the feeder element, which preferably runs substantially flat, or in a surface plane, at the level of the second end of the feeder element. To form a ventilation function by way of the ventilation opening, arranged separately from the spacer, on the feeder element, it is preferably the case that a centring pin which corresponds with the ventilation opening, or a structural or extension part is arranged on the mould plate and/or on the mould pattern. The centring pin or structural part are in this case designed to bridge the spacing between the first and the second end of the feeder element before the deformation and, at least in sections, project into the feeder cavity such that, as the mould chamber of the moulding installation is filled with the mould material, the mould material can be prevented from entering the feeder cavity.

The support surface of the spacer is preferably in the form of a circular ring segment, wherein the in each case relatively long side edges of the support surface preferably have a curvature corresponding to the spacing of the respective side edge to the opening axis of the passage opening. By means of the shape of the support surface which preferably varies in the direction of the length and the width of the feeder element at the underside thereof, an improved support function of the feeder system on regions of the mould plate and/or of the mould pattern is ensured. Alternatively, instead of a spacer on the feeder element, provision is made of, for example, two spacers which are arranged so as to be uniformly spaced apart from the opening axis of the passage opening. In order that a uniform support function is ensured by means of the two or more spacers arranged on the feeder element, the spacers preferably each have a support surface of identical size and shape.

In a preferred refinement of the arrangement according to the invention, the distance between the opening axis of the passage opening and the centre of volume of the feeder cavity has a distance dimension which, in relation to the vertical axis running perpendicularly through the opening axis and the centre of volume, amounts to at least 10% of the length dimension of the feeder element measured in the direction of the vertical axis. The opening axis of the passage opening is offset with respect to the centre of volume by a distance dimension X (X>0) along a vertical axis running through the opening axis and the centre of volume. The distance dimension X can in this case be compared with the length dimension L of the feeder element measured in the direction of the vertical axis. In a series of embodiments, the ratio X/L amounts to between at least 10%, 15% or 20%. In further series of embodiments, the ratio X/L amounts to less than 25%, 20% or 15%. Specific embodiments have a ratio of offset X to length dimension L of the feeder element in a range between approximately 17% and 27%. That is to say, the offset of the opening axis with respect to the centre of volume corresponds to approximately one quarter to one sixth of the length of the feeder element.

The opening axis of the passage opening preferably serves as a positioning axis for the feeder system along a centring axis of a centring pin or of a structural part which protrudes from the mould pattern and/or mould plate. Through the use of the opening axis of the passage opening as a positioning axis, it is ensured that the passage opening, which is designed for the passage of liquid metal, is oriented or positioned exactly or very precisely with respect to a passage which is connected to the casting chamber of the casting mould. For the positioning of the feeder system on the mould plate and/or on the mould pattern, use is made, for example, of a centring pin arranged on the mould plate and/or mould pattern. As an alternative to a centring pin, it is also possible for a structural part to be provided which is formed on the mould pattern and/or mould plate and which has the shape of the passage opening and over which the deformable side wall of the passage opening is pushed. It is preferably provided that the inner side of the side wall that delimits the passage opening bears in frictionally locking fashion against the structural part of mould pattern and/or mould plate. In one refinement, the structural part is an integral constituent part of mould pattern and/or mould plate.

The assembly element preferably has, on its periphery, a protruding rim which engages in regions around the feeder insert and which extends in sections or entirely along the rim edge, of the assembly element. It has been found that, by means of the rim which runs along the periphery of the assembly element, the assembly element is reinforced and thus buckling or deformation of the assembly plate during the compaction of the mould material is reduced, or in the best case prevented. The rim may be formed through the provision of a bend, a fold, a kink or a bead on the assembly element. In the case of an elongate assembly element (which has different dimensions in its areal plane), the rim may extend at least in sections along the in each case relatively long rim edges of the assembly element. Such a rim is proposed for example by EP 2 489 450 B1 (DE 20 2011 103 718 U1), which preferably extends all the way along the periphery or rim edge of the feeder element so as to form a skirt.

In one embodiment of the arrangement according to the invention, the rim is oriented at an angle of between 10° and 160°, preferably at angle of 90°, with respect to the areal plane of the assembly element. In other embodiments, the rim may be inclined away from the areal plane of the assembly element at an angle of for example 20° to 130°, 30° to 120°, 40° to 110°, 50° to 100° or 60° to 95°. It is self-evident that, in the case of angle is greater than 90°, the rim which protrudes for example as a flange from the periphery of the assembly element is bent inward beyond the assembly element, wherein the angle is measured from the outside from the plane of the assembly element. In the case of angles of up to 90°, the rim generally extends so as to be inclined outward with respect to the assembly plate. A rim at an angle of up to 90° yields the advantage that, by means of the rim, self-centring orientation of the feeder insert on the feeder element is ensured by way of abutment surfaces that correspond with one another. This advantageous refinement of the invention may be combined in each case with the independent aspects of the present invention. With regard to preferred combinations, that which has been stated in the corresponding text passages applies correspondingly in each case.

The rim preferably has a height, parallel to the direction of the opening axis, in a range between 5 millimeters and 10 millimeters. Thus, depending on the embodiment at hand, reliable orientation between feeder element and feeder insert, and a fixed connection between feeder element and feeder insert, can be realized.

The assembly element preferably has different dimensions in the direction of the vertical axis, which preferably runs through the opening axis and through the centre of volume, and in the direction of a transverse axis running perpendicularly to said vertical axis, wherein the assembly element preferably has a greater dimension in the direction of its vertical axis than in the direction of its transverse axis. Thus, the assembly element substantially defines the shape of the feeder element, as the assembly element is part of the feeder element and predominantly delimits the outer dimensions thereof in the direction of the vertical axis and of the transverse axis. The feeder element is preferably overall, elliptical, rectangular, irregularly polygonal or rounded as viewed along the opening axis of the passage opening. Depending on the usage situation, a shape expedient for the application of the feeder element, and preferably the feeder insert which is received by the feeder element, are selected.

A further refinement of the invention provides that the assembly element is a substantially planar assembly plate or an assembly plate with an at least curved surface region. With the embodiment of the assembly element as an assembly plate, a structurally simple design of the region which connects the feeder insert to the feeder element is ensured. In one embodiment, the assembly plate has a substantially planar surface, on the periphery of which there may be arranged an angled rim. An alternative embodiment provides at least a curved profile of the assembly plate in the direction of the vertical axis or of the transverse axis, whereby the strength of said assembly plate is increased. Owing to the improved strength of the assembly plate, it is preferably the case that deformation, preferably buckling, during the process of compaction of the mould material is counteracted.

For this purpose, the assembly plate preferably has a convex curvature, preferably a convex bulge, preferably in the direction at least of the vertical or transverse axis, on the outer side facing toward the first feeder element end. This advantageous refinement of the invention may be combined in each case with the independent aspects of the present invention. With regard to preferred combinations, that which has been stated in the corresponding text passages applies correspondingly in each case.

A further preferred refinement of the arrangement according to the invention provides that the side wall which delimits the passage opening on the feeder element, and/or the tipping prevention element which is preferably in the form of a support part, are/is compressible, preferably non-reversibly compressible. With the compressibility of side wall and support part, an advantageous possibility for configuring the deformability of the side wall and of the support part, which is variable in terms of height, is realized. It is preferably the case that the side wall and the support part are irreversibly compressible to such that the deformation can no longer be reversed. The deformation of the side wall of the passage opening or of the wall of the ventilation opening, which is in the form of a support part, is to be understood in the broadest sense to mean the realization of a change in spacing, preferably a reduction in spacing, between the first end and the second end of the feeder element. The deformable wall regions on the passage opening and/or of the ventilation opening may, in a possible embodiment, for example as disclosed in DE 201 12 425 U1, be in the form of an annular part of hat-shaped form. The projecting cover surface corresponds to the first end of the feeder element, and the encircling collar corresponds to at least a partial region of the second end of the feeder element. The projecting ring forms, in regions, the deformable side wall of the passage and/or ventilation opening.

The passage opening, and likewise the ventilation opening wall which is in the form of a support part, are preferably arranged substantially at the width midpoint of the assembly element in relation to the width measured in the direction of the transverse axis. Along the vertical axis of the feeder element, the side wall of the passage opening, and a support part, which is variable in terms of its height dimension, have a symmetrical arrangement on the feeder element. Owing to the symmetrical arrangement, tipping about the vertical axis, which runs transverse it with respect to the opening axis of the passage opening, is advantageously prevented.

In a preferred refinement of the invention, the side wall which delimits the passage opening, and/or the ventilation opening wall which is formed as a support part, comprises at least one step, wherein each step is preferably formed by a first side wall region and by a second side wall region adjoining the first side wall region, and wherein the second side wall region is provided at a different angle with respect to the opening axis of the passage opening than the first side wall region. It is preferably the case that the compressible side wall and the ventilation opening wall have multiple steps with in each case first and second side wall regions, wherein the individual steps also adjoin one another, or the side wall regions of the different steps are connected to one another. The deformable side wall of the passage opening and the deformable ventilation opening wall, which is preferably in the form of a support part, are of similar form to the deformable side wall of the feeder element, of a feeder system that can be mounted on a mould plate, disclosed in EP 2 489 450 B1 (DE 20 2011 103 718 U1) and EP 2 664 396 B1 (DE 20 2012 102 418 U1). This advantageous refinement of the invention may be combined in each case with the independent aspects of the present invention. With regard to preferred combinations, that which has been stated in the corresponding text passages applies correspondingly in each case.

The stepped side wall and/or the stepped wall preferably has multiple first side wall regions extending substantially radially with respect to the opening or central axis and multiple second side wall regions extending approximately axially. Approximately right-hand good steps are formed on the side wall of the passage opening and on the wall of the ventilation opening by the first and second side wall regions. The stepped compressible side wall and/or wall preferably comprises 2 to 6 steps. The multiplicity of steps gives rise to advantageous compressibility or collapsibility during the deformation of the side wall and support part, and an associated change in spacing between the first and second ends of the feeder element. In a series of embodiments, the stepped side wall and/or stepped ventilation opening wall has an extent dimension in the direction transversely with respect to the opening axis of the passage opening. The extent dimension of the compressible section of the feeder element corresponds to approximately 20% to 50%, 25% to 45% or preferably 25% to 40% of the length in the direction of the vertical axis of the feeder element. If the compressible section of the feeder element comprises circular steps, the extent dimension corresponds to the maximum diameter of the step arranged adjacent to the second end of the feeder element.

It is preferably the case that the first side wall region has an orientation with respect to the opening axis in an angle range of between 70° and 95°, and/or that the second side wall region has an orientation with respect to the opening axis in an angle range of between 0° and 30°. An alternative refinement provides that at least the first side wall region, which is in abutment with the feeder insert, has an orientation with respect to the opening axis which lies in an angle range of between 45° and 80°. By means of the targeted orientation of the first side wall region, which is in direct abutment with the feeder insert, self-centring of the feeder element and feeder insert during the compaction process during the production of the casting mould is achieved.

In one embodiment, the first side wall region is substantially circular, and/or, in a preferred embodiment, the second side wall region has an approximately cylindrical shape. By means of the selected circular or cylindrical shape, it is advantageously possible to form circular steps for forming the preferably compressible sections on the feeder element. Circular steps have the advantage in relation to steps of other shape that they deform substantially uniformly under the action of a force acting preferably parallel to the opening axis. This gives rise to a more easily predictable force profile on the feeder element during the compaction of the mould material. The opening axis preferably extends through the centres of area of the free cross-sections of the passage opening formed in each case at the first end and at the second end of the feeder element. The free cross-section of the passage opening at the first end and at the second end are preferably arranged concentrically. It is preferable, in order to improve the deformability or compressibility, as described for example in EP 1 567 294 B3, for the side wall of the passage opening and/or or the ventilation duct wall to have one or more weakened regions, preferably regions of reduced material thickness. By way of the weakened regions, it is achieved that the side wall and/or ventilation duct wall is deformed, preferably folded, upset or kinked, at predefined sections.

Taking into consideration the problem described above, it is self-evident that the extent of compression and the force required to effect or generate the compaction of the mould material are influenced by a range of different factors such as, for example, the material used for producing the feeder element and the shape or form and the material thickness of the side wall which delimits the passage opening from the first end to the second end of the feeder element. It is likewise self-evident that individual feeder elements are designed in accordance with the intended usage and the pressure values to be expected in conjunction therewith and the feeder size specifications.

In one refinement of the arrangement according to the invention, it is preferably provided that the initial compressive strength of the feeder element amounts to no more than 7000 newtons, preferably no more than 5000 newtons, and/or the initial compressive strength of the feeder element amounts to at least 250 newtons, preferably at least 500 newtons. In the present case, the initial compressive strength is to be understood to mean the force required to initiate the compression (that is to say the change in spacing between the first and second ends of the feeder element) and irreversibly deform the feeder element beyond a degree of flexibility exhibited by said feeder element in its unused and uncompressed state. The initial compressive strength should not exceed particular limit values, in the present case 7000 newtons solely owing to preferred embodiments of the feeder element now having two deformable regions, because damage to or fracture of the feeder insert connected to the feeder element could otherwise occur. If two deformable regions are provided on the feeder element, the deformation resistance of each individual side wall (passage opening) and/or wall (ventilation opening) must be adapted. To ensure a predetermined minimum strength of the feeder element, the initial compressive strength thereof is at least 250 newtons, preferably greater than 500 newtons.

One refinement of the present invention preferably provides that the diameter of the passage and/or ventilation opening of the feeder element increases from the first end to the second end of the feeder element. Thus, a passage and/or a ventilation opening extending from the first end of the feeder element to the second end of the feeder element may have the shape of a frustum. To permit the compression of a side wall or wall which is possibly of frustoconical form, said side wall or wall preferably has, as described in more detail above, multiple weakened regions which are provided at predetermined spacing intervals along the direction of extent thereof. In the case of a preferred stepped configuration of the side wall of the passage opening, and/or wall of the ventilation opening, according to the invention, it is provided that the length of a first series of side wall regions and/or of a second series of side wall regions increases in stepped fashion toward the first end of the feeder element. The steps, formed between the first and the second end of the feeder element, of the stepped side wall and wall have different dimensions, preferably length dimensions. Furthermore, a controlled compression or change in spacing is ensured, whereby it is prevented that, aside from the first end of the side wall, further regions of the side wall, which is collapsible in stepped fashion, come into contact with the mould pattern and/or the mould plate.

It is preferably the case that the side wall of the passage opening and/or the preferably compressible ventilation duct wall have/has a material thickness which lies in the range between 0.1 millimeters and 1.5 millimeters. In particular embodiments of the feeder element, the material thickness may also lie in the range between 0.3 millimeters and 1.2 millimeters, or preferably between 0.4 and 0.9 millimeters. The ideal material thickness of the side wall regions, which are preferably arranged in stepped fashion with respect to one another, may vary in accordance with the intended usage, and is influenced inter alia by the size, the shape and the material used for forming the feeder element, and possibly also by the method for producing the feeder element.

In a further refinement, the feeder element has a unipartite structural form, and is preferably formed by being pressed from a single plate body of uniform thickness, wherein the plate body is preferably formed from a metal, or comprises at least one metal, selected from the group composed of steel, aluminium, aluminium alloys, brass and the mixtures thereof. In one embodiment of the invention, the feeder element is produced by way of a deep-drawing process, wherein a material blank is drawn or pressed into a mould under the mechanical action of a moulding tool. The drawing or pressing of the material blank may be realized by way of a range of suitable moulding tools. To be suitable for a deformation process of said type, the material to be used should be deformable enough that tearing or fracture of the material does not occur during the shaping process. Feeder elements according to the invention are preferably produced from cold-rolled steels. Alternative refinements of the feeder element provide for the use of a variety of other suitable materials, preferably metals. Metals, such as for example steel, aluminium, aluminium alloys, brass and copper preferably have the deformability required to be able to be correspondingly compressed at at least one region of the feeder element according to the invention. The metals that are preferably used for forming the deformable region of the feeder element may advantageously, owing to their strengths, be used for forming the non-deformable spacer on the feeder element or for forming the guided part on the feeder element. By means of the stated metals, it is basically possible to ensure adequately high strength of the non-deformable regions of the feeder element.

Furthermore, a feeder insert according to the invention is preferred which is formed from an exothermic feeder material or comprises exothermic feeder material at least in sections or is formed from insulating feeder material or comprises insulating feeder material at least in sections, and/or the feeder element is formed from a material, or comprises a material, selected from the group composed of metals, plastics, cardboards, the mixtures thereof and the composite materials thereof. With the use of exothermic or insulating feeder materials for the feeder insert according to the invention, good economy and in particular a good sealing feed during the casting process are achieved. By means of exothermic and insulating feeder materials, the metal situated in the feeder system can be kept in the liquid state over a relatively long period of time. As feeder material, it is however also possible to simply use a mould sand, in particular quartz sand, bound using a binding agent. Instead of commercially available feeder materials, it is by contrast possible for the feeder element, which is seated by way of its first end preferably directly on the mould plate and/or the mould pattern, to be composed of other materials, which are preferably selected from the group composed of metals, plastics, cardboards, the mixtures thereof and the composite materials thereof. The materials used should be deformable in order to be able to achieve at least a part of the object according to the invention in respect of the feeder element.

In a preferred refinement of the arrangement according to the invention, the feeder insert arranged on the feeder element has a cylindrical or non-cylindrical recess for a tip of a centring pin. It is preferable for the feeder insert to have, at least on the inside at its end situated opposite the passage opening and possibly also opposite the ventilation opening, one or more conically running wall sections and/or one or more cylindrical or non-cylindrical recesses for the pin tip. By means of the wall sections and/or recesses formed on the feeder insert for the tip of the centring pin, simplified mounting of the feeder system on the centring pin, or mounting of the feeder system on the mould pattern and/or on the mould plate, is achieved. It is preferably provided that the at least one conically running wall section, and the recess adjoining the latter, are formed on the inner contour of the feeder insert. The cylindrical recess is preferably arranged concentrically with respect to the opening axis of the passage opening or with respect to the central axis of the ventilation opening. Thus, it is preferably the case that, regardless of which opening (passage opening and/or ventilation opening) is used for positioning of the feeder system with respect to the mould pattern and/or the mould plate, exact orientation or positioning is possible in each case. The recess on the feeder insert preferably corresponds in form-fitting fashion with the outer contour of a centring pin tip that can be inserted into the recess. A recess is to be understood both to mean a cylindrical depression on the inner side of the feeder insert and a preferably cylindrical aperture on the feeder insert, such that, after the compaction of the mould material, the centring pin tip protrudes from or projects out of the top side of the feeder insert of the feeder system.

It is preferable for the feeder insert to have, on the inside at one end, preferably at an end of which is situated above the opening axis during the use of the feeder system, one or more integrally formed webs or wall sections which divide up the feeder cavity in the manner of chambers. By means of a web or wall section which projects from the inner side, said web or wall section being designed for example as a so-called Williams strip or Williams wedge, premature formation of a casting skin on the surface of the liquid metal above the opening axis of the feeder system is counteracted. This improves the effect of said feeder insert, specifically that of keeping the liquid metal situated therein in the liquid state. During the use of the feeder system, that is to say when the opening axis of the passage opening is arranged horizontally, the one or more webs are arranged on an inner wall section of the feeder insert arranged above the opening axis, and said web(s) preferably extend(s) parallel to the vertical axis, which preferably runs through the opening axis. The webs, also known under the designation as "Williams strip" or "Williams wedge", may be a separately formed insert part designed to be inserted into the feeder cavity, formed by the feeder element and feeder insert, of the feeder system. Alternatively, the one or more web(s) is or are formed integrally on the inner contour of the feeder insert, thus forming an integral constituent part thereof. This advantageous refinement of the invention may be combined in each case with the independent aspects of the present invention. With regard to preferred combinations, that which has been stated in the corresponding text passages applies correspondingly.

The present invention also relates to a feeder element for use in an arrangement according to the invention. Thus, a further aspect of the invention relates to a feeder element for use in arrangement according to one of the above-described embodiments, or as part of a feeder system (as defined above or below) for the casting of metal separable casting moulds, in particular in vertically separable casting moulds, comprising a first end for mounting on to a mould pattern and/or a mould plate, a second end, which is situated opposite the first end and which has an assembly element for receiving a feeder insert of the feeder system, at least one passage opening, which extends from the first end to the second end, for the liquid metal, wherein the passage opening is delimited by a side wall, wherein the side wall can be deformed so as to reduce the spacing between the first and second ends, and wherein the passage opening has an opening axis, wherein the feeder element is designed to delimit, together with a feeder insert, a feeder cavity for receiving liquid metal, wherein the feeder element comprises a tipping prevention element, which is arranged on the feeder element, and/or are one or more ventilation openings for the ventilation of the feeder cavity which is delimited by the feeder element and feeder insert.

With a feeder element according to the invention, which in a preferred embodiment of the invention has one or more tipping prevention elements and/or corresponds with one or more tipping prevention elements, tipping of the feeder system during the compaction of the mould material, and an associated change in spacing between the first and second ends of the feeder element, can be advantageously counteracted. An alternative independent refinement of the feeder element according to the invention provides that the feeder element has, in addition to the passage opening for the liquid metal, one or more ventilation openings for the ventilation of the feeder cavity delimited by the feeder element and feeder insert. Thus, an accelerated casting process is realized without the risk of the feeder system being insufficiently filled with liquid metal owing to a build-up of air in the interior thereof. All explanations given with regard to the feeder element as part of an arrangement according to the invention also apply to the feeder element according to the invention.

A further aspect of the invention relates to a kit for producing an arrangement according to the invention (as discussed above or below), comprising a feeder element, a feeder insert and a mould plate and/or a mould pattern as per at least one of the preferred embodiments described above. Such a kit according to the invention thus comprises a feeder element which is designed for being preferably directly mounted onto a mould pattern and/or a mould plate and on which, preferably on an assembly element of the feeder insert, there is arranged or received a feeder insert, which can be assembled to form a feeder system according to the invention, and a mould plate and/or a mould pattern. An alternative refinement provides for the feeder insert to be arranged with a spacing to the mould plate and/or to the mould pattern. The feeder element and the feeder insert are designed to form a feeder cavity for receiving liquid metal.

In this case, a given feeder element may be combined with differently designed feeder inserts. It is likewise possible for a given feeder insert to be combined with differently designed feeder elements.

A kit according to the invention preferably comprises, besides a feeder element and a feeder insert, a centring pin for being received in form-fitting fashion by the feeder system, preferably by the passage opening or the ventilation opening in the feeder element according to the invention. The feeder system (which is formed from feeder element and feeder insert) can preferably be pushed over the centring pin or mounted onto the centring pin. The centring pin for receiving or holding the feeder insert has a centring pin foot with a shape which is matched in particular to the soffit surface of the passage opening and/or of the ventilation opening in the feeder element. The cross section of the centring pin foot is, corresponding to the passage and/or ventilation opening, preferably formed so as to be not cylindrical but preferably selected from the group composed of oval, unround, flattened circle, flattened oval, triangular, tetragonal or polygonal. In this way, a means for preventing rotation between the centring pin and feeder insert is realized. Furthermore, the centring pin and at least the feeder element are designed such that the feeder system or the feeder and the centring pin can assume only a single position relative to one another, in which the feeder element and the feeder insert can be pushed onto the centring pin (key-lock principle). Furthermore, targeted positioning of the feeder system on the mould plate and/or on the mould pattern is ensured, and misuse is advantageously prevented.

A further aspect of the invention relates to a mould plate for use in an arrangement according to the invention, the mould plate being designed according to at least one of the preferred embodiments of the present invention described below and comprising a tipping prevention element arranged on the mould plate and/or an extension part for forming a ventilation duct. With regard to preferred refinements or developments of the mould plate according to the invention, reference is made to the embodiments according to the invention of the arrangement according to the invention as described above, to the feeder element according to the invention, and to the kit according to the invention.

Figure 2A:
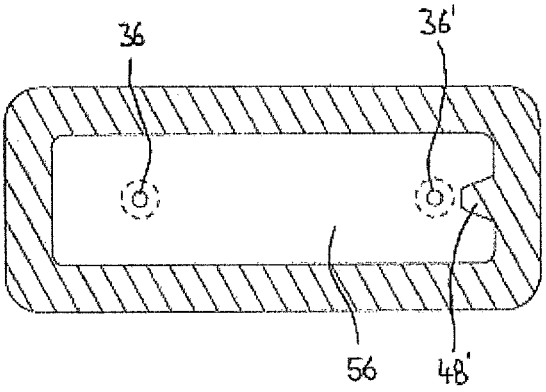
Figure 2B:
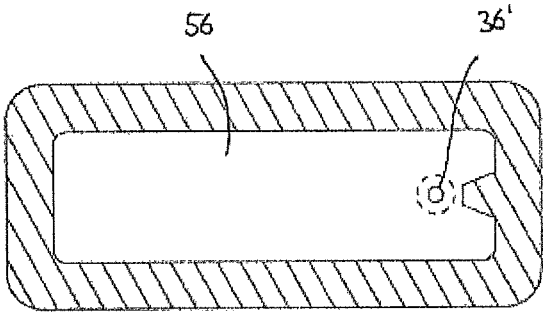
Figure 2C:
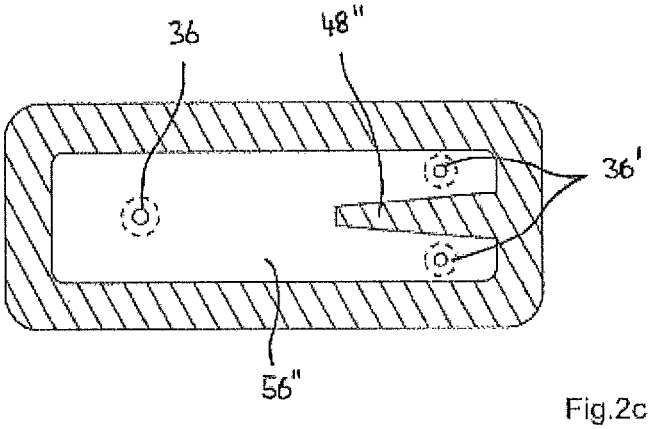
Figure 3A:
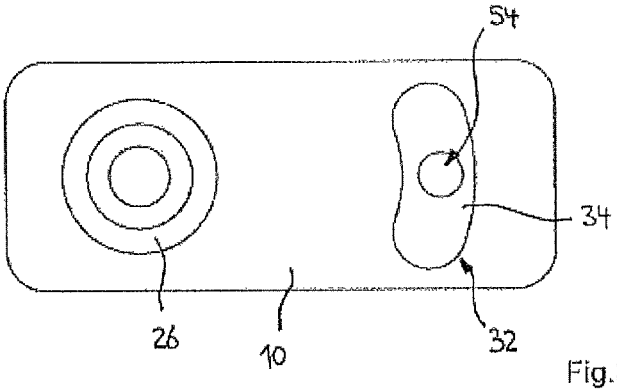
Figure 3B:
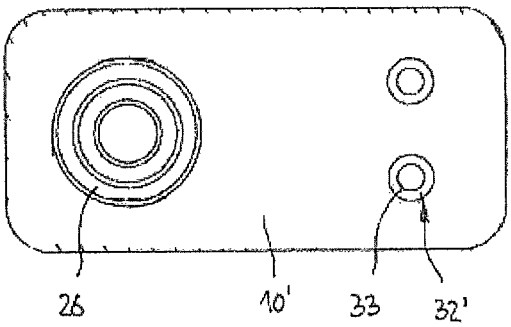
Figure 3C:
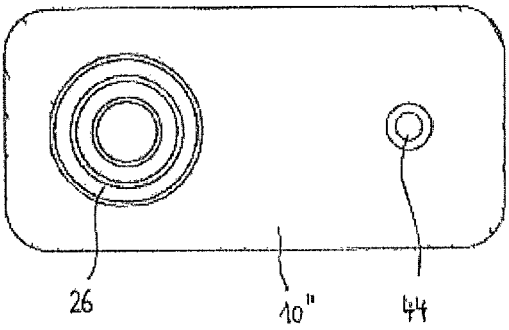
Figure 3D:
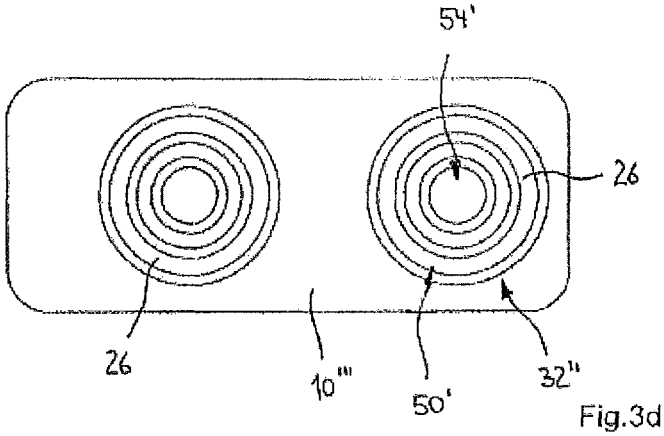
Figure 3E:
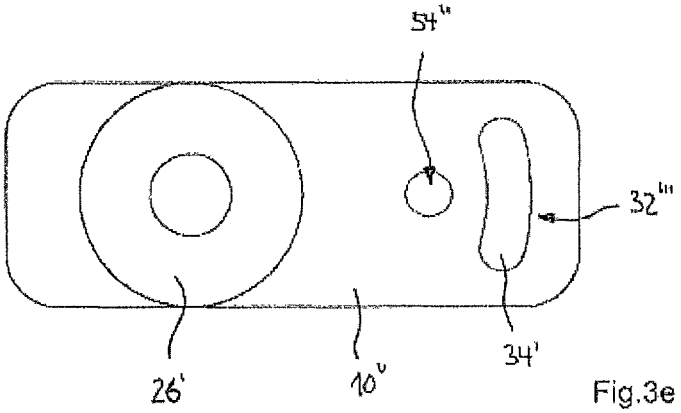

The invention will be described in more detail below on the basis of multiple exemplary embodiments, from which further inventive features will emerge, and with reference to the appended figures, in which:

FIGS. 1*a* to 1*f*: show views of different exemplary embodiments of arrangements according to the invention in longitudinal section;

FIGS. 2*a* to 2*c*: show images of possible exemplary embodiments of feeder inserts according to the invention in sectional views from below;

FIGS. 3*a*-3*e*: show views of multiple exemplary embodiments of feeder inserts according to the invention in respect of plan views; and FIGS. 4*a*-4*d*: schematically show, in the form of sectional illustrations, the production of a casting mould from the mounting of a feeder insert according to the invention onto a pivotable mould plate to the assembly of the reduced mould halves to form a casting mould.

FIG. 1*a* shows an arrangement 2 according to the invention which comprises a mould plate 4 arranged in a horizontal orientation, on which mould plate there is mounted or arranged a section of a mould pattern 6. Also arranged on the mould plate 4 is a feeder system 8 according to the invention, which has a feeder element 10 and a feeder insert 12. The feeder element 10 and feeder insert 12 form or delimit a feeder cavity 14 for receiving liquid metal. To ensure positioning of the feeder element 8 on the mould plate 4, there is fixedly arranged on the mould plate 4 at least one centring pin 16 by means of which the feeder system 8 is held in position. The feeder element 10 comprises a first end 18, by which the feeder element is, in the embodiment shown, seated directly on the mould plate 4. Alternatively, the first end 18 may be arranged spaced apart from the mould plate by way of a spacer (not shown). The feeder element 10 furthermore comprises a second end 20 which is situated opposite the first end and which has an assembly element 22 on which the feeder insert 12 is arranged. A passage opening 24 for liquid metal extends from the first end 18 to the second end 20, wherein the passage opening is delimited by a side wall 26. The side wall 26 is a stepped form and is deformable such that the spacing between the first end 18 and the second end 20 of the feeder element 10 can decrease during the production of a casting mould and an associated compaction process of a mould material used for the production. The passage opening 24 has an opening axis 28 which is offset with respect to the centre of volume (not illustrated) of the feeder cavity. The opening axis preferably extends through the centres of area of the free cross sections of the passage opening formed in each case at the first end and at the second end of the feeder element. To prevent tipping of the feeder system 8 about the first end 18 owing to the force that acts on the feeder system 8 during the compaction of the mould material, and the associated change in spacing between the first and second ends 18, 20, the arrangement 2 has tipping prevention elements 30, 32 which counteract a pivoting movement of the feeder system out of the opening axis 28. The tipping prevention elements 30, 32 are arranged spaced apart from the opening axis 28. In the present embodiment, the tipping prevention elements 30 is a second centring pin 16' as a guide part, and the tipping prevention element 32 is a spacer 34 which is guided along the centring pin and which protrudes from the feeder element 10 in the direction of the mould plate 4 and by means of which, after the deformation of the side wall 26, a minimum spacing between the feeder element 10 and the mould plate 4 is maintained. For improved guidance of the feeder system 8, the feeder insert 12 has recesses 36, 36' arranged in a wall region 56 coaxially with respect to the opening axis 28 and with respect to the spacer 34. Furthermore, by means of the spacer 34 on the feeder element 10, a ventilation opening 54 is formed, by means of which a ventilation function out of the feeder cavity 14 is implemented.

Figure 1B:
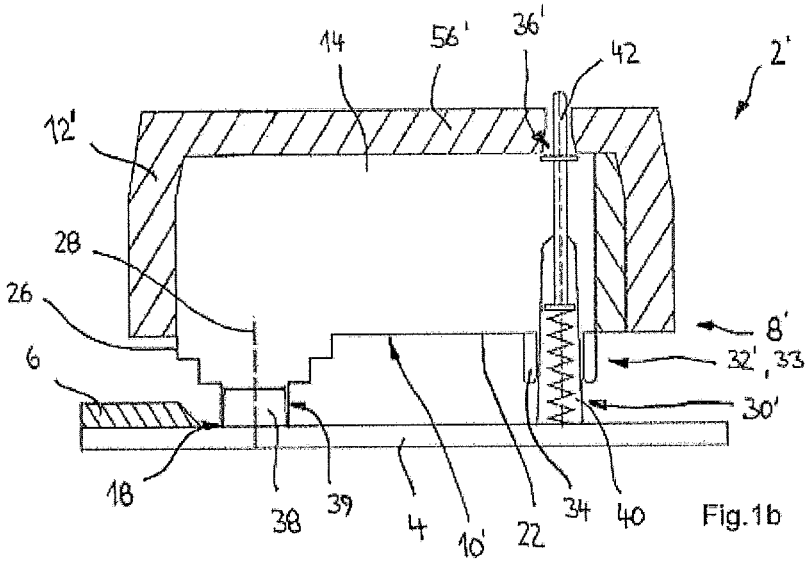

FIG. 1*b* shows a second exemplary embodiment of an arrangement 2' according to the invention, having a mould plate 4, having a section of a mould pattern 6 arranged thereon, and having a feeder system 8'. By contrast to the previous embodiment, the feeder system 8' is positioned and/or held by way of a structural part 38 which, from the mould plate, projects in sections into the passage opening 24 and over which the side wall 26 is pushed by way of at least its front section 39 adjacent to the first end 18. To counteract tipping of the feeder system 8' about the first end 18 of the feeder element 10, it is again the case that two tipping prevention elements 30', 32' are provided. The tipping prevention elements 30' is a spring pin 40 which is arranged on the mould plate 4 and on which the feeder insert 12' is supported. Furthermore, the tipping prevention element 32', which is in the form of a spacer 34 and in the form of a guided part 33, is guided along the spring pin 40. In the present case, the feeder insert 12' has, on its wall region 56', only one recess 36' for the pin tip 42 of the spring pin 40, which protrudes or projects at least partially into or through the wall 56' of the feeder insert 12'.

Figure 1C:
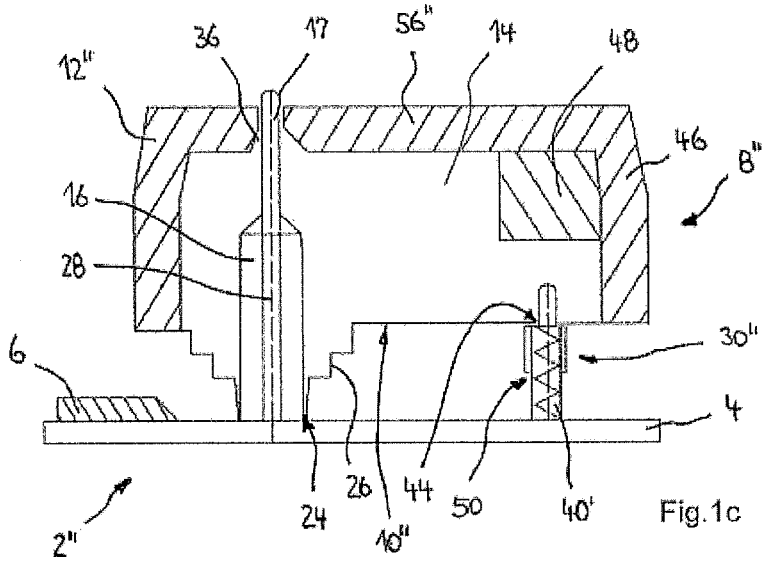

FIG. 1*c* shows a third exemplary embodiment of an arrangement 2' according to the invention. The arrangement comprises a mould plate 4 and a section of a mould pattern 6, and also a feeder system 8" arranged on the mould plate. The feeder system has a feeder element 10" and a feeder insert 12". The feeder element 10" is seated by way of its first end preferably directly on the mould plate, wherein the feeder system is positioned and held relative to the mould plate 4 by way of a centring pin 16 which corresponds with the passage opening 24. The centring pin tip 17 again projects through a recess 36 provided in the wall 56" of the feeder insert 12". As a tipping prevention elements 30", there is again provided a spring pin 40', which engages with an aperture 44, arranged at a distance to the opening axis 28 of the passage opening 24, in the feeder element 10". The tipping prevention elements 30', which is designed as a spring pin 40', has in the present case the function of a compressible support part 50 which is variable in terms of its height dimension. A support part of said type preferably has a deformation behaviour adapted to the deformation of the stepped, compressible side wall which extends between the first end and the second end of the feeder element. By means of the adapted or coordinated deformation behaviour, it is sought to achieve that, during the deformation of the side wall 26, the feeder element 10" approaches the mould plate 4 in preferably uniform fashion. To prevent the formation of a skin on the surface of the liquid metal in the feeder cavity 14 during use, the feeder insert 12" has a web 48 which, during use, extends vertically from the wall region 46, and which is also referred to as "Williams strip".

Figure 1D:
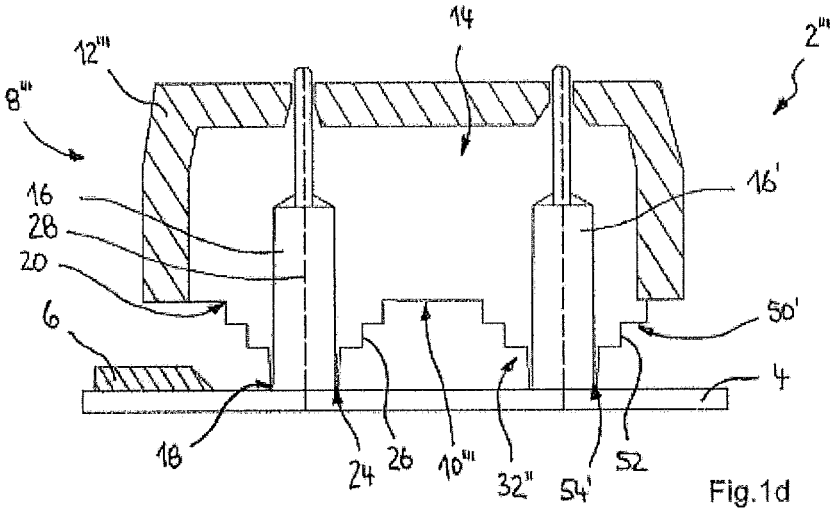

FIG. 1*d* shows a further embodiment of an arrangement 2''' which comprises a feeder system 8''' which has a feeder element 10''' and a feeder insert 12''' connected to the feeder element 10'''. As is always in the exemplary embodiments presented above, these form a feeder cavity 14. The feeder element 10''' has a passage opening 24 for the liquid metal, which passage opening is delimited by a stepped, preferably compressible side wall 26. In this case, the feeder element is seated by way of its first end 18 on the mould plate 4. As a tipping prevention elements 32", there is provided on the feeder element 10''' a support part 50' which has a stepped, compressible wall 52 of approximately identical form to that of the side wall 26. Thus, the feeder element 10''' has two compressible regions which, by way of a first end 18, are seated on and/or arranged with a spacing to the mould plate and which have a second end 20 on which the feeder insert is arranged. In the event of a decrease in the spacing between the first end 18 and the second end 20, which is the result of a force acting on the feeder system, which force acts on the feeder insert during the compaction of mould material during the production of a casting mould, the side wall 26 of the passage opening 24 and the wall 52 of the tipping prevention elements 32" are deformed preferably uniformly. For the positioning of the feeder system 8''', two centring pins 16, 16' are arranged on the mould plate 4, by means of which centring pins the feeder system 8''' is received. As is always with the tipping prevention elements 32, 32' shown in FIGS. 1*a* and 1*b*, a ventilation function out of the feeder cavity 14 can be implemented by means of the deformable wall 52. Via ventilation openings 54' (FIGS. 1*a* and 1*b*) which are formed by the tipping prevention elements 32" and which, during use, are in contact with a ventilation duct produced in the casting mould, air situated in the feeder cavity 14 can be discharged in an effective manner, with result that reliable filling of the feeder cavity 14 with liquid metal is ensured.

Figure 1E:
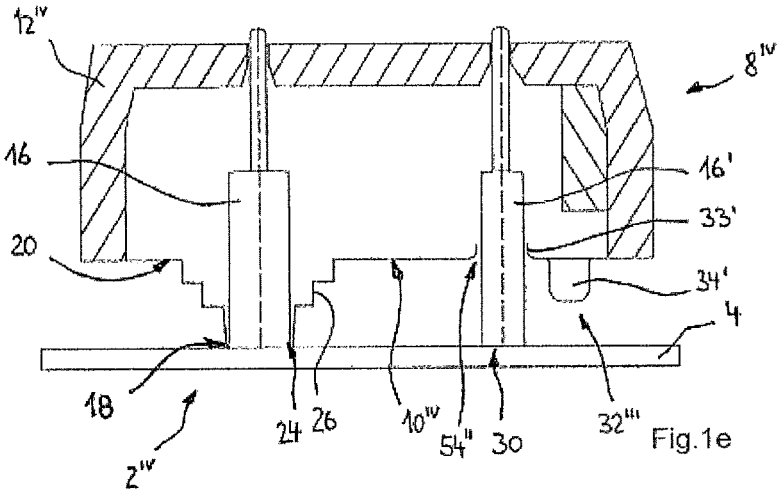

FIG. 1*e* shows a further embodiment of an arrangement according to the invention in its initial position after the mounting of the feeder system $\mathbf{8}^{IV}$ onto a mould plate 4. The feeder system $\mathbf{8}^{IV}$ again comprises a feeder element $\mathbf{10}^{IV}$ and a feeder insert $\mathbf{12}^{IV}$, wherein the feeder element $\mathbf{10}^{IV}$ is seated by way of its first end 18 on the mould plate 4, and the feeder insert $\mathbf{12}^{IV}$ is arranged on the second end 20 of said feeder element. Between the first and second ends 18, 20 there extends usually a stepped, deformable side wall 26 by means of which the passage opening 24 for the liquid metal is delimited. At the same time, the feeder system $\mathbf{8}^{IV}$ is positioned on the mould plate by means of the centring pin 16. In an alternative embodiment, the positioning may also be realized by way of a structural part illustrated in FIG. 1*b*. In the present case, multiple tipping prevention elements 30, 32''' are provided at a distance from the passage opening 24. On the one hand, as tipping prevention element 30, it is again the case that a second centring pin 16' is arranged, as a guide part, on the mould plate 4, which second centring pin is preferably at a distance from the deformable side wall 26 of the feeder element $\mathbf{10}^{IV}$, said distance being greater than the distance between the opening axis 28 of the passage opening 24 and the centre of volume, which is spaced apart therefrom and which is not shown, of the feeder cavity 14. Corresponding with the centring pin 16' is a part 33' which is guided along said centring pin and which simultaneously forms a ventilation opening 54" after the removal of the centring pin 16'. A spacer 34', as tipping prevention element 32''', is arranged on the feeder element $\mathbf{10}^{IV}$ separately from the ventilation opening 54". The spacer 34' projects from the underside of the feeder element $\mathbf{10}^{IV}$ and, after the deformation of the stepped side wall 26, is preferably in abutment with the top side of the mould plate 4.

Figure 1F:
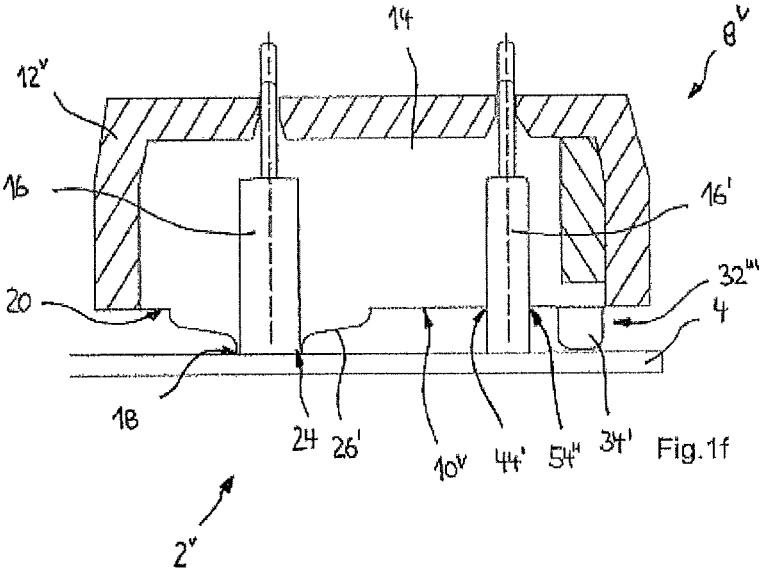

FIG. 1*f* shows an embodiment of an arrangement $\mathbf{2}^{V}$ according to the invention having a feeder system $\mathbf{8}^{V}$ which, on its feeder element $\mathbf{10}^{V}$, has not a stepped side wall with multiple steps but a side wall 26 which has a curved, hat-like shape. The hat-shaped side wall likewise has a preferably cylindrical passage opening 24. During a compression of the mould material, said hat-like side wall 26' is, like the stepped side wall 26 (FIGS. 1*a* to 1*e*), deformed such that a change in spacing occurs between the first end 18 and the second end 20 of the feeder element $\mathbf{10}^{V}$. The centring pin 16 is used for positioning the feeder system $\mathbf{8}^{V}$. Alternatively, it would also be possible for the feeder system $\mathbf{8}^{V}$ to be oriented by way of a structural part (FIG. 1*b*) on the mould plate 4. As tipping prevention elements, the present arrangement $\mathbf{2}^{V}$ has a second centring pin 16' which is arranged at a distance from the centring pin 16 and which corresponds with an aperture 44' in the feeder element $\mathbf{10}^{V}$. The aperture 44' likewise serves as a ventilation opening 54" out of the feeder cavity 14. Furthermore, on the feeder element $\mathbf{10}^{V}$, as in the present embodiment, a separately arranged spacer 34' is formed so as to project in the direction of the mould plate 4. As shown in FIG. 1*f*, said spacer 34' is preferably in direct abutment with the mould plate 4 after compression has taken place.

FIGS. 2*a* to 2*c* show possible embodiments of feeder inserts. The feeder inserts are shown in each case in a view from below. As can be seen from the present figures, the feeder inserts have virtually identical wall thicknesses, though may have different wall thicknesses depending on the specific usage situation. The exemplary embodiment shown in FIG. 2*a* comprises two recesses 36, 36' in the wall regions 56, correspondingly to the embodiment shown in FIG. 1*a*. Adjacent to the recess 36', there is provided a web 48' which projects into the feeder cavity 14. The embodiment shown in FIG. 2*b*, correspondingly to the embodiment shown in FIG. 1*b*, has only one recess 36' in the wall region 56'. The feeder insert shown in FIG. 2*c* has, in addition to the recess 36 for a centring pin 16 which corresponds with the passage opening 24, two further recesses 36' in the wall region 56", which two further recesses are arranged to both sides of a web 48" which extends into the feeder cavity 14 and which is also referred to as "Williams strip". The recesses 36' correspond with centring pins 16' which serve as tipping prevention elements and along which the feeder element, which is connected to the feeder insert, is guided at least in sections.

FIGS. 3*a* to 3*e* show different embodiments of the feeder elements 10, 10', 10", 10''', $\mathbf{10}^{V}$ shown inter alia in FIGS. 1*a* to 1*f*. The feeder elements 10, 10', 10", 10''', $\mathbf{10}^{V}$ have a substantially rectangular outline, with at least one deformable side wall 26, 26' being formed thereon. In the various embodiments of the feeder element, tipping prevention elements 32, 32', 32", 32''' of various form are arranged and/or formed at a distance from the opening axis 28 (FIG. 1*a*) of the side wall 26, 26' which delimits the passage opening 24. The intention of the tipping prevention elements is to prevent tipping about the first end 18 of the feeder element, which is seated on the mould plate 4. The tipping prevention elements 32, 32', 32", 32''' arranged on the feeder element 10, 10', 10", 10''', $\mathbf{10}^{V}$ may for example be in the form of spacers 34, 34' which protrude from the underside in the direction of the mould plate, in the form of a part 33, 33' which is guided along a centring pin, or in the form of a support part 50' with a stepped, deformable wall 52 similar to the side wall 26.

Figure 4A:
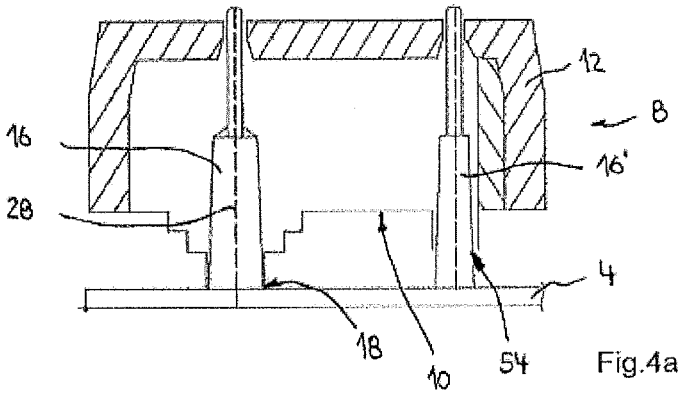
Figure 4B:
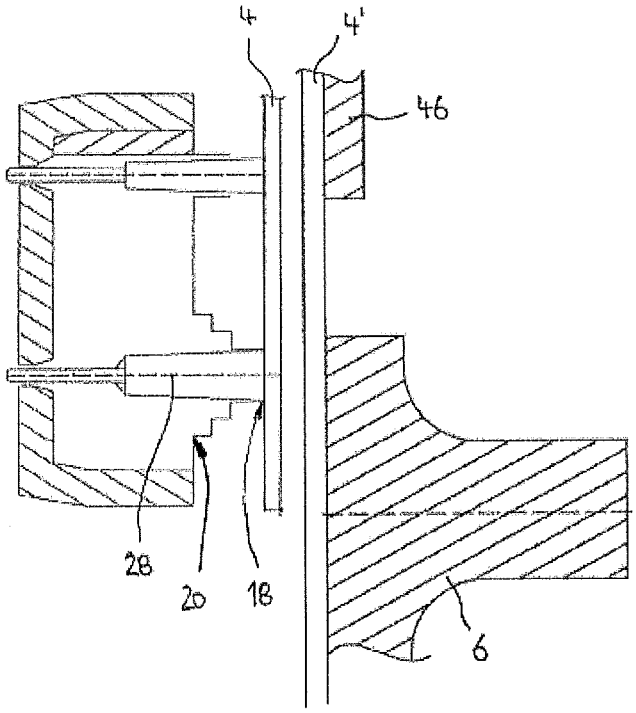

FIGS. 4*a* to 4*d* show a possible embodiment of a method for producing a casting, wherein a feeder system 8 designed according to the invention is pushed or mounted by way of its passage opening 24, and by way of the ventilation opening 54 in the feeder element 10, onto two centring pins 16, 16'. The centring pins 16, 16' are in this case arranged fixedly on the mould plate 4. The feeder element 10 is arranged by way of its first end directly on with a spacing to the mould plate 4. It is however preferable for the first end 18 of the feeder element 10 to be in direct abutment with the mould plate, which at this point in time is in a horizontal orientation, as shown in FIG. 4*a*. The feeder insert 12 is fastened to the feeder element 10 by way of the assembly element 22. The mould plate 4 is subsequently pivoted into the vertical position (FIG. 4*b*) such that the opening axis 28 of the feeder element 10 moves into the horizontal orientation. At the same time, the mould plate 4 is oriented parallel to a second mould plate 4'. In this embodiment, only the feeder system 8 is mounted on the mould plate 4. The mould pattern 6 and an extension part 46 provided for forming a ventilation duct are arranged on the mould plate 4'.

Figure 4C:
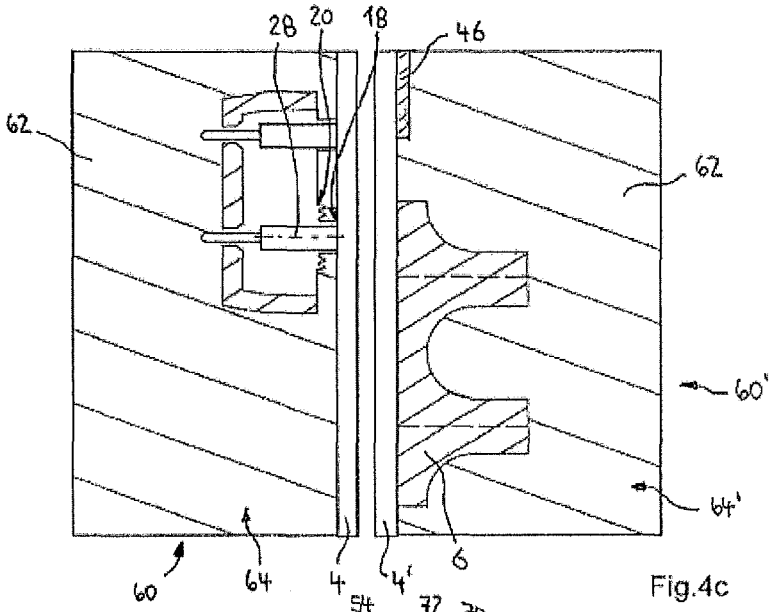
Figure 4D:
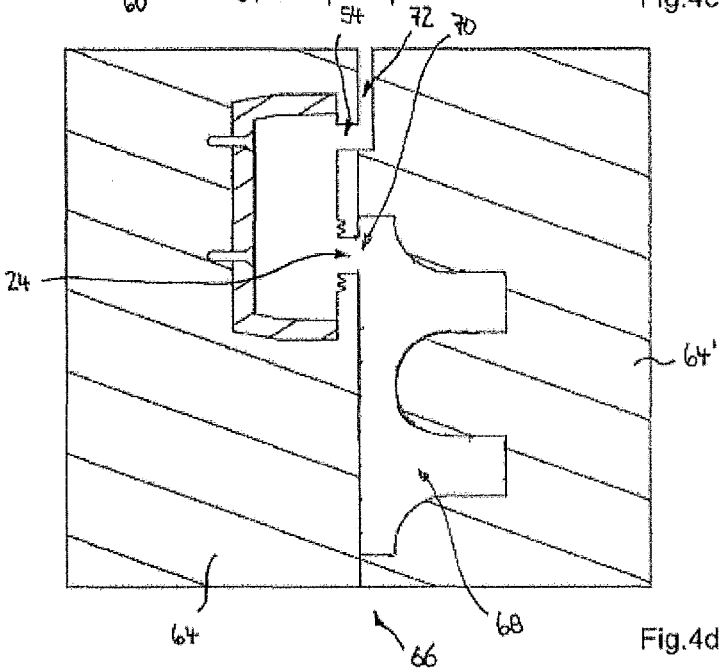

As shown in FIG. 4*c*, it is the case that, after the two mould plates 4 and 4' have been oriented parallel to one another, chambers 60, 60' are produced around the mould plates, into which chambers there is then poured or introduced a mould material 62. After the chambers 60, 60' have been filled, a pressing process is performed, and thus the mould material 62 in the chambers is compacted. During the compaction of the mould material, a force is generated which acts at least parallel to the opening axis 28 and in the direction of the first end 18 of the feeder element 10, whereby the side wall 26 between the first and second ends 18, 20 of the feeder element 10 is deformed, preferably kinked or folded, such that simultaneously, the spacing both between the first and second ends and between the feeder system 8 and the mould plate 4 is reduced. Owing to the change in spacing between the feeder system and mould plate, that part of the mould material which is situated under the feeder element is also compacted. During the compaction, however, the tipping prevention elements 30, 32 in the form of the centring pin 16' and at least the spacer 34 prevent the feeder system tipping out of the opening axis about the first end 18 of the feeder element 10. After the compaction, the feeder element thus preferably has a uniform spacing to the mould plate 4, whereby uniformly sealing abutment of the first end 18 of the feeder element 10 at a transition 70 to a subsequent casting mould is ensured. With the compaction of the mould material 62, solid mould halves 64, 64' for the casting mould are produced in each of the chambers 60, which mould halves, after the removal of the mould plates 4, 4' and thus simultaneously of the mould pattern 6 and of the extension part 56, are assembled to form a casting mould 66, cf. FIG. 4*d*. The casting mould 66 that is produced has a cavity 68 for the liquid metal to be introduced into the casting mould, which cavity substantially corresponds to the shape of the casting to be produced. The cavity 68 has a transition 70 to the passage opening 24 of the feeder system 8 in the first mould half 64. A ventilation duct 72 which corresponds to the ventilation opening 54 in the feeder element 10 of the feeder system according to the invention is formed in the casting mould 66. By means of the ventilation duct 72, it can advantageously be ensured that the feeder system is virtually completely filled with liquid metal during casting operation. In this way, during the shrinkage of the metal in the cavity 68 of the casting mould 66, the supply of liquid metal can be ensured. The ventilation duct 72 (FIG. 4*d*) is formed or arranged where the extension part 46 was previously situated or arranged (cf. FIGS. 4*b* and 4*c*).

All of the feeder elements shown in the figures are feeder elements according to the invention, as they have a tipping prevention element and/or a ventilation opening. The arrangements according to the invention illustrated in the figures can be produced using the constituent parts of a corresponding kit.

In the appended figures, identical components are denoted by the same reference signs.

The invention claimed is:

1. Arrangement for use in the production of a separable casting mould, comprising:

(i) a mould plate (4, 4') and/or a mould pattern (6), (ii) a feeder system (8, 8', 8", 8''',$\mathbf{8}^{IV}$, $\mathbf{8}^{V}$) having a feeder element (10, 10', 10", 10''', $\mathbf{10}^{IV}$, $\mathbf{10}^{V}$) and having a feeder insert (12, 12', 12", 12''',$\mathbf{12}^{IV}$), wherein feeder element (10, 10', 10", 10''', $\mathbf{10}^{IV}$, $\mathbf{10}^{V}$) and feeder insert delimit a feeder cavity (14) for receiving liquid metal, wherein the feeder element (10, 10', 10", 10''', $\mathbf{10}^{IV}$, $\mathbf{10}^{V}$)

has a first end (18) by which the feeder element (10, 10', 10", 10''', $\mathbf{10}^{IV}$, $\mathbf{10}^{V}$) is seated on, or arranged with a spacing to, the mould plate (4) and/or the mould pattern (6), has a second end (20) which is situated opposite the first end (18) and which has an assembly element (22) on which the feeder insert (12, 12', 12", 12''', $\mathbf{12}^{IV}$) is arranged, has at least one passage opening (24), which extends from the first end to the second end, for the liquid metal, wherein each of the at least one passage openings (24) is delimited by a side wall (26, 26'), wherein the side wall can be deformed so as to reduce the spacing between the first and second ends (18, 20), and wherein each of the at least one passage openings (24) has an opening axis (28), wherein the feeder cavity (14) has a centre of volume which is offset relative to the opening axis (28), wherein the arrangement additionally comprises one or more tipping prevention elements (30, 30', 30", 32, 32', 32", 32") which are designed to counteract tipping of the feeder system (8, 8', 8'",$8^{IV}$, $8^{V}$) out of the opening axis (28) about the first end (18) of the feeder element (10, 10', 10", 10'",$10^{IV}$, $10^{V}$) when, in the event of the feeder system being acted on with a force acting parallel to the opening axis (28) and in the direction of the first end (18), the side wall (26, 26') deforms and the spacing between the first and second ends (18, 20) is reduced, wherein the one or more tipping prevention element(s) (30, 30', 30", 32, 32', 32", 32'") are/is spaced apart from the opening axis (28).

2. Arrangement according to claim 1, wherein the one or more tipping prevention elements is arranged on the feeder element, and/or on the mould plate or the mould pattern, at a distance from the deformable side wall of the feeder element, which distance is greater than the distance between the opening axis and the centre of volume, which is offset with respect thereto, of the feeder cavity.

3. Arrangement according to claim 1, wherein the one or more a tipping prevention elements is a support part which is arranged between (i) the mould plate and/or the mould pattern and (ii) the assembly element of the feeder element and/or the feeder insert, wherein the support part is variable in terms of its height dimension.

4. Arrangement according to claim 3, wherein the side wall which delimits each of the at least one passage openings on the feeder element, and/or the tipping prevention element are/is compressible.

5. Arrangement according to claim 3, wherein the side wall which delimits each of the at least one passage openings, and/or a ventilation opening wall which is formed as a support part, comprises at least one step, wherein each step is formed by a first side wall region and by a second side wall region adjoining the first side wall region, and wherein the second side wall region is provided at a different angle with respect to the opening axis of the at least one passage opening than the first side wall region.

6. Arrangement according to claim 1, wherein the one or more tipping prevention elements is a spacer which projects in the direction of the feeder element from a surface, facing toward the feeder element, of the mould pattern and/or of the mould plate, and/or protrudes from the feeder element in the direction of the mould plate or of the mould pattern, and which is designed to maintain a minimum spacing between (ii) the feeder element and (i) the mould plate or the mould pattern after the deformation of the side wall.

7. Arrangement according to claim 1, wherein the one or more tipping prevention elements is a guide part which is arranged on the mould pattern and/or the mould plate and which corresponds with an additional receptacle on the feeder element, and along which the additional receptacle slides during the deformation of the side wall.

8. Arrangement according to claim 1, wherein the opening axis of each of the at least one passage openings serve as a positioning axis for the feeder system along a centring axis of a centring pin or of a structural part which protrudes from the mould pattern and/or mould plate.

9. Arrangement according to claim 1, wherein the assembly element has, on its periphery, a protruding rim which engages in regions around the feeder insert and which extends in sections or entirely along the periphery, preferably a rim edge, of the assembly element.

10. Arrangement according to claim 1, wherein the feeder element has a unipartite structural form, and is formed by being pressed from a single plate body of uniform thickness, wherein the plate body comprises at least one metal selected from the group composed of steel, aluminium, aluminium alloys, brass, and the mixtures thereof.

11. Arrangement according to claim 1, wherein the feeder insert is formed from a exothermic feeder material or comprises exothermic feeder material at least in sections or is formed from insulating feeder material or comprises insulating feeder material at least in sections, and/or or the feeder element is formed from a material, or comprises a material, selected from the group composed of metals, plastics, cardboards, the mixtures thereof and the composite materials thereof.

* * * * *